US008585414B2

(12) United States Patent
Takeda

(10) Patent No.: US 8,585,414 B2
(45) Date of Patent: Nov. 19, 2013

(54) SUBSTRATE CONNECTING STRUCTURE

(75) Inventor: Mikiya Takeda, Tokyo (JP)

(73) Assignee: NEC Display Solutions, Ltd., Tokyo (JP)

( * ) Notice: Subject to any disclaimer, the term of this patent is extended or adjusted under 35 U.S.C. 154(b) by 33 days.

(21) Appl. No.: 13/502,947

(22) PCT Filed: Oct. 30, 2009

(86) PCT No.: PCT/JP2009/068667

§ 371 (c)(1),
(2), (4) Date: Apr. 19, 2012

(87) PCT Pub. No.: WO2011/052068

PCT Pub. Date: May 5, 2011

(65) Prior Publication Data

US 2012/0208387 A1 Aug. 16, 2012

(51) Int. Cl.
*H01R 12/00* (2006.01)

(52) U.S. Cl.
USPC ..... 439/74; 439/160; 439/378

(58) Field of Classification Search
USPC ..... 439/74, 160, 378
See application file for complete search history.

(56) References Cited

U.S. PATENT DOCUMENTS

| | | | | |
|---|---|---|---|---|
| 5,268,820 | A * | 12/1993 | Tseng et al. | 361/785 |
| 5,863,211 | A * | 1/1999 | Sobotta et al. | 439/74 |
| 7,258,569 | B1 * | 8/2007 | Johnson et al. | 439/378 |
| 7,589,974 | B2 * | 9/2009 | Grady et al. | 361/735 |
| 7,762,831 | B2 * | 7/2010 | Lin | 439/373 |
| 7,798,819 | B2 * | 9/2010 | Kudo et al. | 439/74 |
| 8,156,629 | B2 * | 4/2012 | Ceelen | 29/464 |
| 2005/0048812 | A1 * | 3/2005 | Sandoval et al. | 439/74 |
| 2005/0191897 | A1 | 9/2005 | Kondou et al. | |
| 2006/0003608 | A1 * | 1/2006 | Sandoval et al. | 439/74 |
| 2006/0079113 | A1 * | 4/2006 | Minich | 439/378 |
| 2007/0037434 | A1 * | 2/2007 | Fedder et al. | 439/378 |
| 2011/0294337 | A1 * | 12/2011 | McAlonis et al. | 439/378 |

(Continued)

FOREIGN PATENT DOCUMENTS

| | | |
|---|---|---|
| JP | 02-106860 | 8/1990 |
| JP | 04-147588 A | 5/1992 |

(Continued)

OTHER PUBLICATIONS

International Search Report in PCT/JP2009/068667 dated Dec. 1, 2009 (English Translation Thereof).

*Primary Examiner* — Ross Gushi
(74) *Attorney, Agent, or Firm* — McGinn IP Law Group, PLLC

(57) ABSTRACT

Provided is a substrate connecting structure that includes a support housing to which a main substrate is attached, and a shield housing for housing a relay substrate, the support housing being provided with a first opening for exposing a first connector provided in the main substrate, a first guide, and a pair of hinges, the shield housing being provided with a second opening for exposing a second connector provided in the relay substrate, and a second guide that works cooperatively with the first guide, the first guide and the second guide guiding the shield housing so that the shield housing can move perpendicularly to a main surface of the support housing provided with the first opening, ends of the pair of hinges being located between the shield housing and the support housing and being adapted to be rotated to separate the shield housing from the support housing.

16 Claims, 12 Drawing Sheets

(56) References Cited

U.S. PATENT DOCUMENTS

| | | | | |
|---|---|---|---|---|
| 2012/0149223 | A1* | 6/2012 | Feldman et al. | 439/157 |
| 2013/0090001 | A1* | 4/2013 | Kagotani | 439/378 |
| 2013/0135833 | A1* | 5/2013 | Chen et al. | 361/752 |

FOREIGN PATENT DOCUMENTS

| | | | |
|---|---|---|---|
| JP | 06-097681 | A | 4/1994 |
| JP | 06-140097 | A | 5/1994 |
| JP | 08-125301 | A | 5/1996 |
| JP | 09-000689 | A | 1/1997 |
| JP | 2001-265464 | A | 9/2001 |
| JP | 2003-186410 | A | 7/2003 |
| JP | 2005-243446 | A | 9/2005 |
| JP | 2007-157984 | A | 6/2007 |
| JP | 2007-234736 | A | 9/2007 |

* cited by examiner

SUBSTRATE CONNECTING STRUCTURE

TECHNICAL FIELD

The present invention relates to a structure for connecting two or more substrates.

BACKGROUND ART

In an electronic device, a main substrate and a plurality of other substrates are connected via cables or flexible wiring boards (hereinafter, collectively referred to as "cables"). Specifically, as shown in FIG. 9, a plurality of connectors 61 are provided on main substrate 60, and a connector (not shown) provided at one end of the cable is connected to each connector 61. The connection of main substrate 61 and the other substrates via the cables and the connectors enables supplying of power from main substrate 61 to the other substrates and transmission of data between the main substrate and the other substrates.

CITATION LIST

Patent Literature

Patent Literature 1: JP08-125301A

SUMMARY OF INVENTION

Problems to be Solved

However, it takes time and labor to connect the connector provided to each cable (hereinafter, sometimes referred to as "cable-side connector") to each of the plurality of connectors provided in the main substrate (hereinafter, sometimes referred to as "substrate-side connectors"). The cable-side connector and the substrate-side connector may also be incorrectly connected. When the cable-side connector is connected to or removed from the substrate-side connector, the cable-side connector may be obliquely inserted into or pulled out from the substrate-side connector. The oblique insertion or pulling-out of the connector may cause deformation or breakage of connector pins. In particular, even when one of the plurality of connectors on the main substrate is broken, the entire main substrate must be replaced.

Solution to Problems

A connecting structure according to the present invention includes a support housing to which a main substrate is attached and a shield housing for housing a relay substrate. The support housing is provided with a first opening for exposing a first connector provided in the main substrate, a first guide, and a pair of hinges. The shield housing is provided with a second opening for exposing a second connector provided in the relay substrate, and a second guide that works cooperatively with the first guide. The first guide and the second guide guide the shield housing so that the shield housing can move orthogonally to a main surface of the support housing provided with the first opening. Ends of the pair of hinges are located between the shield housing and the support housing and are adapted to be rotated to separate the shield housing from the support housing.

Effects of Invention

According to the present invention, the plurality of cables can be simultaneously connected to the main substrate. Incorrect connection of the connectors and breakage and deformation of the connector pins can be prevented.

DESCRIPTION OF EMBODIMENT

A connecting structure according to an embodiment of the present invention will be described in detail below with reference to the drawings. In the connecting structure according to this embodiment, a relay substrate is detachably connected to a main substrate.

Figure 1A:
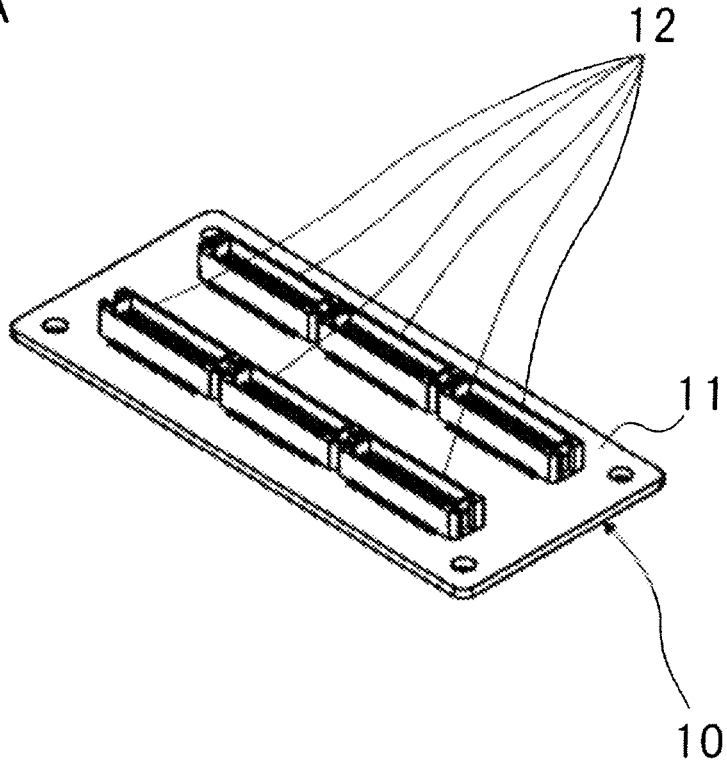
FIG. 1A A first perspective view showing a relay substrate.
Figure 1B:
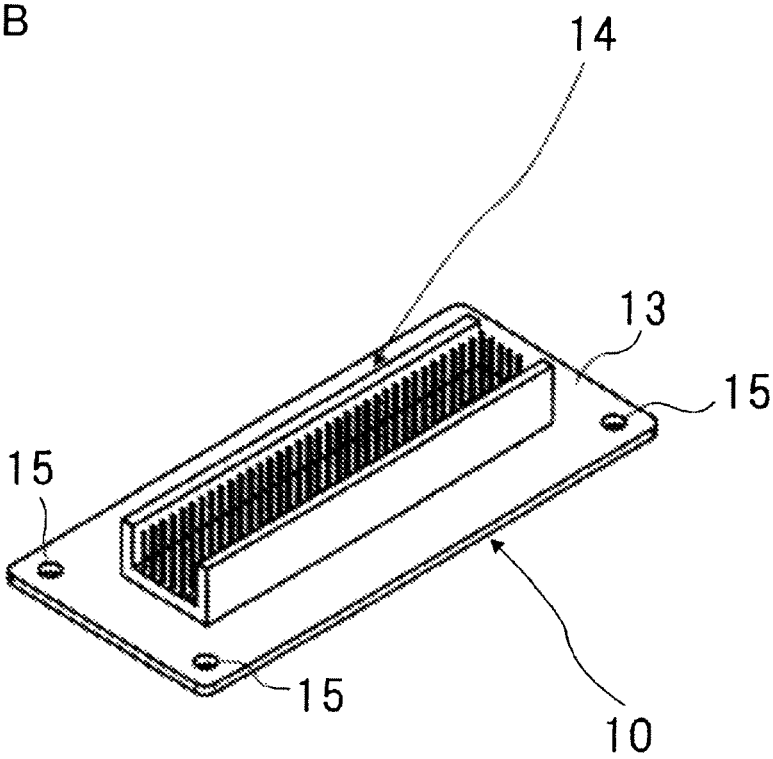
FIG. 1B A second perspective view showing the relay substrate.

FIGS. 1A and 1B are perspective views showing relay substrate 10 according to this embodiment. As shown in FIG. 1A, a plurality of distribution connectors 12 (three pairs of distribution connectors 12 in this embodiment) are provided on one surface (hereinafter "front surface 11") of relay substrate 10. On the other hand, as shown in FIG. 1B, common connector 14 electrically connected to distribution connectors 12 is provided on the other surface (hereinafter "back surface 13") of relay substrate 10. Through-holes 15 are formed at four corners of relay substrate 10.

Figure 2A:
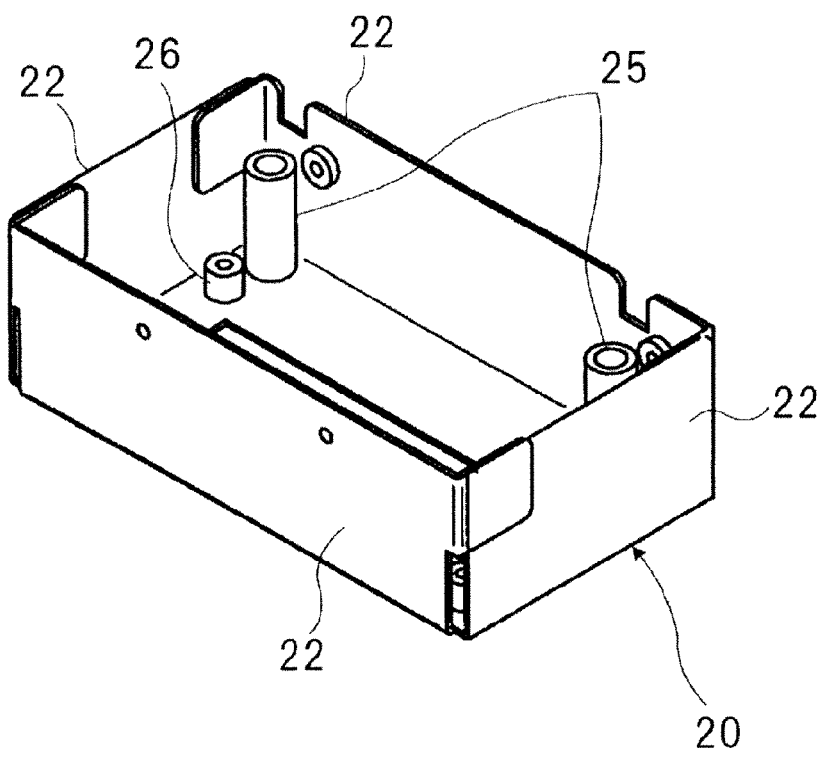
FIG. 2A A first perspective view showing a shield housing.
Figure 2B:
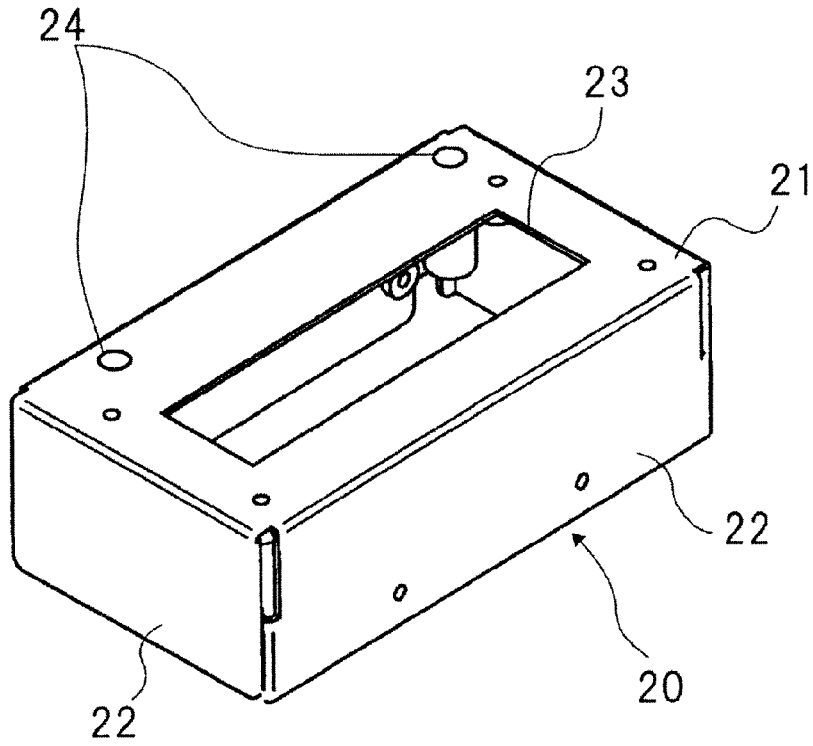
FIG. 2B A second perspective view showing the shield housing.

FIGS. 2A and 2B are perspective views showing shield housing 20 for housing relay substrate 10. Shield housing 20 made of metal is formed into an box shape with one side open. Specifically, shield housing 20 is formed into a box shape that has roughly rectangular bottom part 21 and four side walls 22 perpendicularly rising from respective sides of bottom part 21.

As shown in FIG. 2B, opening 23 is formed in bottom part 21 of shield metal fixing 20 to expose common connector 14 (FIG. 1B) provided on relay substrate 10. Two holes 24 are also formed in and through bottom part 21 of shield metal fixing 20. As shown in FIG. 2A, metal guide tubes 25 are perpendicularly formed on the bottom inner surface of shield metal fixing 20 to communicate with holes 24 shown in FIG. 2B. In other words, two guide tubes 25 are formed upright on the bottom inner surface of shield metal fixing 20 to be parallel to each other. Hole 24 and guide tube 25 have equal inner diameters, and central axes of hole 24 and guide tube 25 match each other.

Further, as shown in FIG. 2A, around opening 23 formed in bottom part 21 of shield metal fixing 20, screw holes 26 are formed corresponding to through-holes 15 (FIG. 1A) formed in relay substrate 10.

Relay substrate 10 is housed inside shield housing 20 having the above-mentioned structure and fixed thereto. Specifically, relay substrate 10 is housed in shield housing 20 with its back surface 13 set opposite to the bottom inner surface of shield housing 20. In this case, common connector 14 (FIG. 1B) provided on back surface 13 of relay substrate 10 and opening 23 (FIG. 2B) formed in bottom part 21 of shield housing 20 are aligned with each other, and common connector 14 is fitted into opening 23. Then, screws 16 (FIG. 6B) are inserted into through-holes 15 formed at the four corners of relay substrate 10, and the inserted screws are forced into screw holes 26 formed in bottom part 21 of shield housing 20. In this way, relay substrate 10 is housed in shield housing 20 and fixed thereto (refer to FIG. 6B). After relay substrate 10 has been fixed to shield housing 20, common connector 14 provided in relay substrate 10 is exposed from opening 23 of shield housing 20 (refer to FIG. 6A).

Figure 3A:
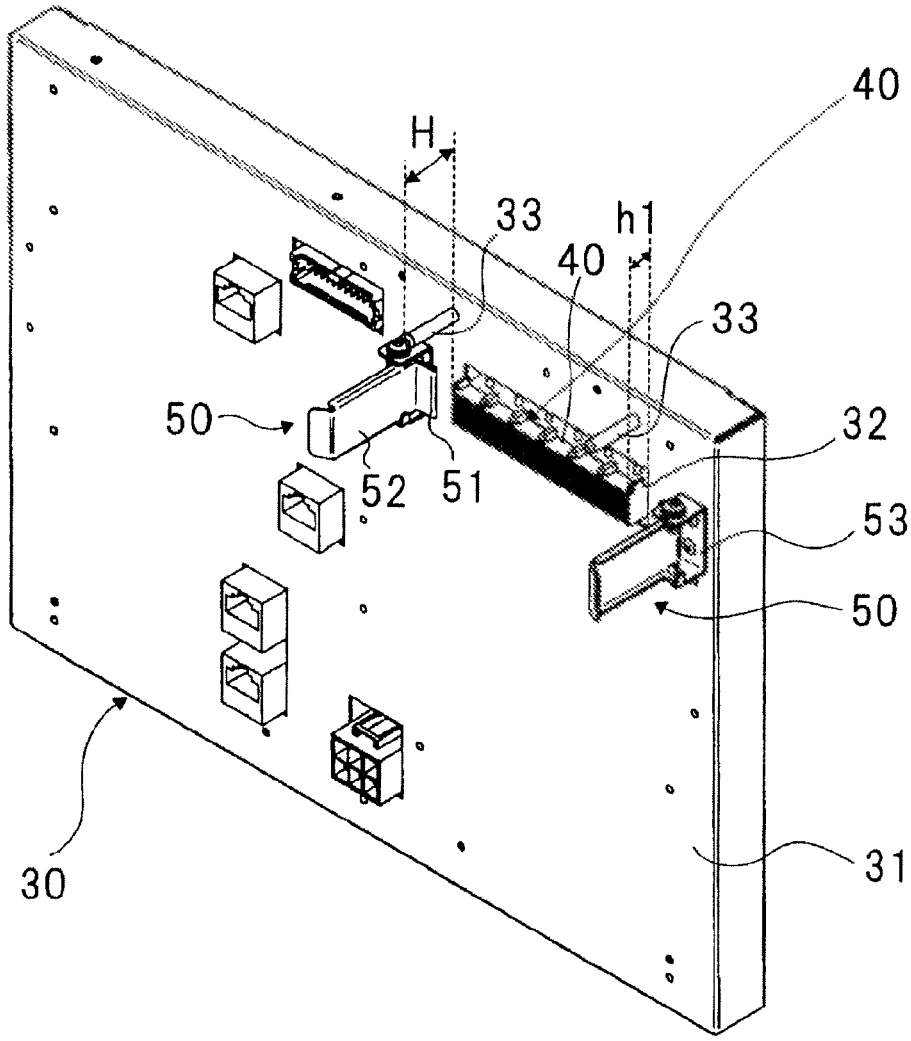
FIG. 3A A first perspective view showing a support housing.
Figure 3B:
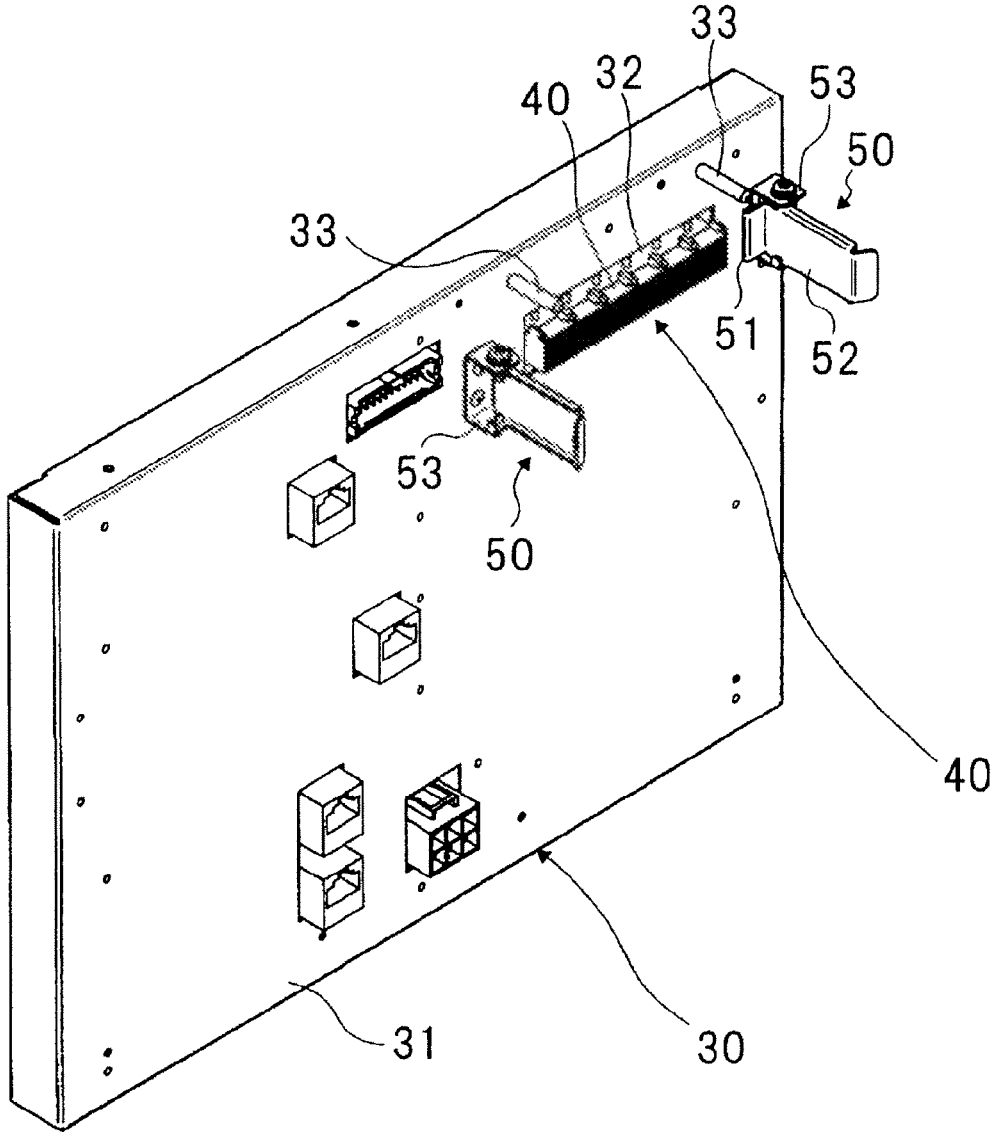
FIG. 3B A second perspective view showing the support housing.

Next, the main substrate to which relay substrate 10 that is fixed to shield housing 20, as described above, is to be connected will be described. FIGS. 3A and 3B are perspective views showing support housing 30 to which the main substrate is to be attached. However, the main substrate is fixed to the opposite side of main surface 31 of shown support housing 30. Thus, FIGS. 3A and 3B show only main connector 40 provided in the main substrate while not showing the main substrate itself.

Support housing 30 is made of metal, and opening 32 for exposing main connector 40 provided in the main substrate fixed to the opposite side of the main surface is formed in main surface 31 of support housing 30. A pair of L-shaped hinges 50 are symmetrically provided on the shown main surface side. Specifically, the pair of hinges 50 are provided on both longitudinal outsides of opening 32. Each hinge 50 includes working part 51 and operation part 52 extending from one end of working part 51 perpendicularly to working part 51. In each hinge 50, a corner between working part 51 and operation part 52 is rotatably supported by rotary shaft 54 (FIG. 8) fixed to bracket 53 fixed to the main surface side of support housing 30.

Working part 51 of each hinge 50 is located between shield housing 20 and support housing 30 when relay substrate 10 is connected to the main substrate. A detailed operation of hinge 50 will be described later.

Further, two metal guide pins 33 to be inserted into guide tubes 25 (FIG. 2A) of shield housing 20 are formed on the main surface side of support housing 30 perpendicularly to main surface 31. In other words, two guide pins 33 are formed upright on the main surface side of support housing 30 to be parallel to each other.

Figure 4:
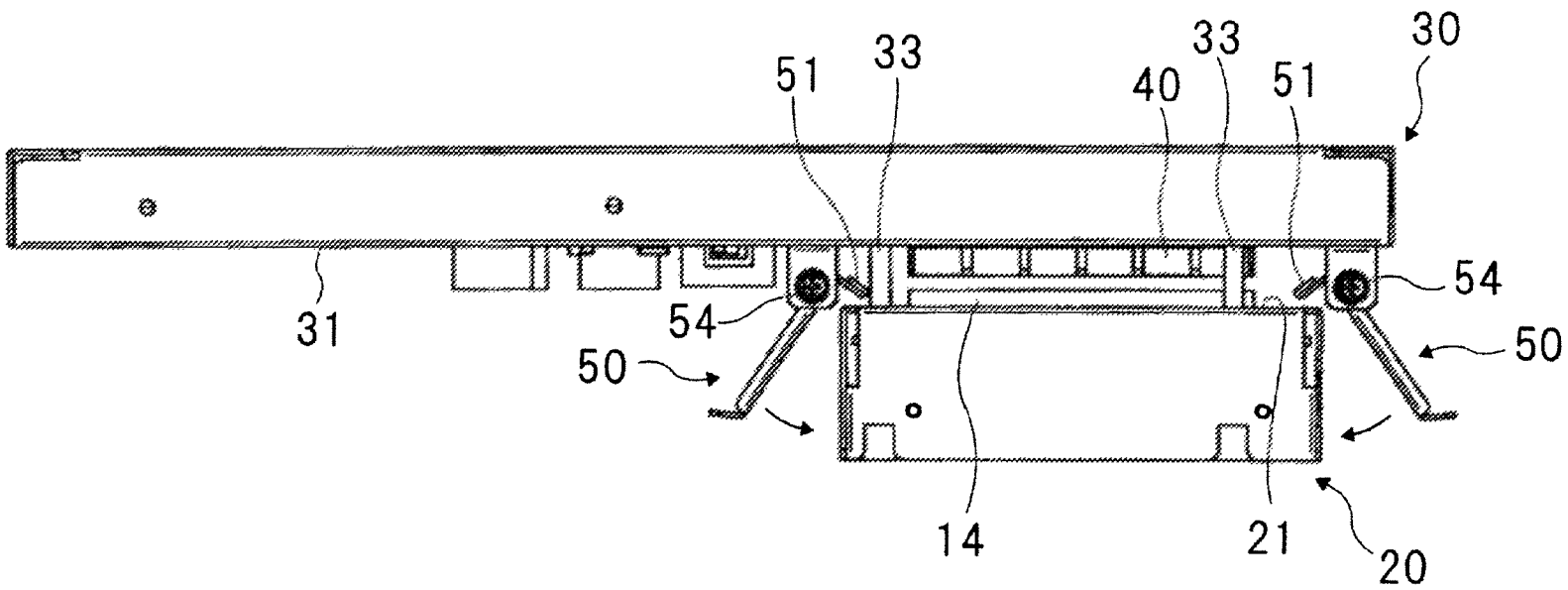
FIG. 4 A plan view showing a procedure for connecting the relay substrate to a main substrate.

Next, a procedure for connecting relay substrate 10 to the main substrate will be described. As shown in FIG. 4, bottom part 21 of shield housing 20 to which relay substrate 10 is fixed is directed to the main surface side of support housing 30, and leading ends of guide pins 33 projecting from support housing 30 are inserted into holes 24 (FIG. 2B) formed in bottom part 21 of shield housing 20. The length (H) of guide pin 33 shown in FIG. 3A is longer than the length obtained by adding together the projecting length (h1) of main connector 40 from main surface 31 of support housing 30 shown in FIG. 3A and the projecting length (h2) of common connector 14 from the bottom outer surface of shield housing 20 shown in FIG. 6A (H>h1+h2). Thus, entry of guide pins 33 into holes 24 is started before common connector 14 projecting from shield housing 20 comes into contact with main connector 40 projecting from support housing 30.

Then, shield housing 20 is brought close to support housing 30 according to guiding by guide pins 33 and guide tubes 25 (FIG. 2A). The bottom outer surface of shield housing 20 accordingly comes into contact with working parts 51 of hinges 50. When shield housing 20 is brought closer to support housing 30, working parts 51 of hinges 50 are pushed by the bottom outer surface of shield housing 20, and hinges 50 rotate inward around rotary shafts 54 (rotate in arrow directions shown in FIG. 4). Common connector 14 projecting from opening 23 of shield housing 20 abuts on main connector 40 projecting from opening 32 of support housing 30.

When shield housing 20 is brought much closer to support housing 30, common connector 14 is connected to main connector 40.

As apparent from the foregoing, in the period from the insertion of the leading edges of guide pins 33 into holes 24 formed in bottom part 21 of shield housing 20 to the connection of common connector 14 to main connector 40, shield housing 20 is guided by guide pins 33 and guide tubes 25 to move in parallel. In other words, shield housing 20 moves perpendicularly to main surface 31 of support housing 30. Thus, common connector 14 is connected straight to main connector 40.

Figure 5:
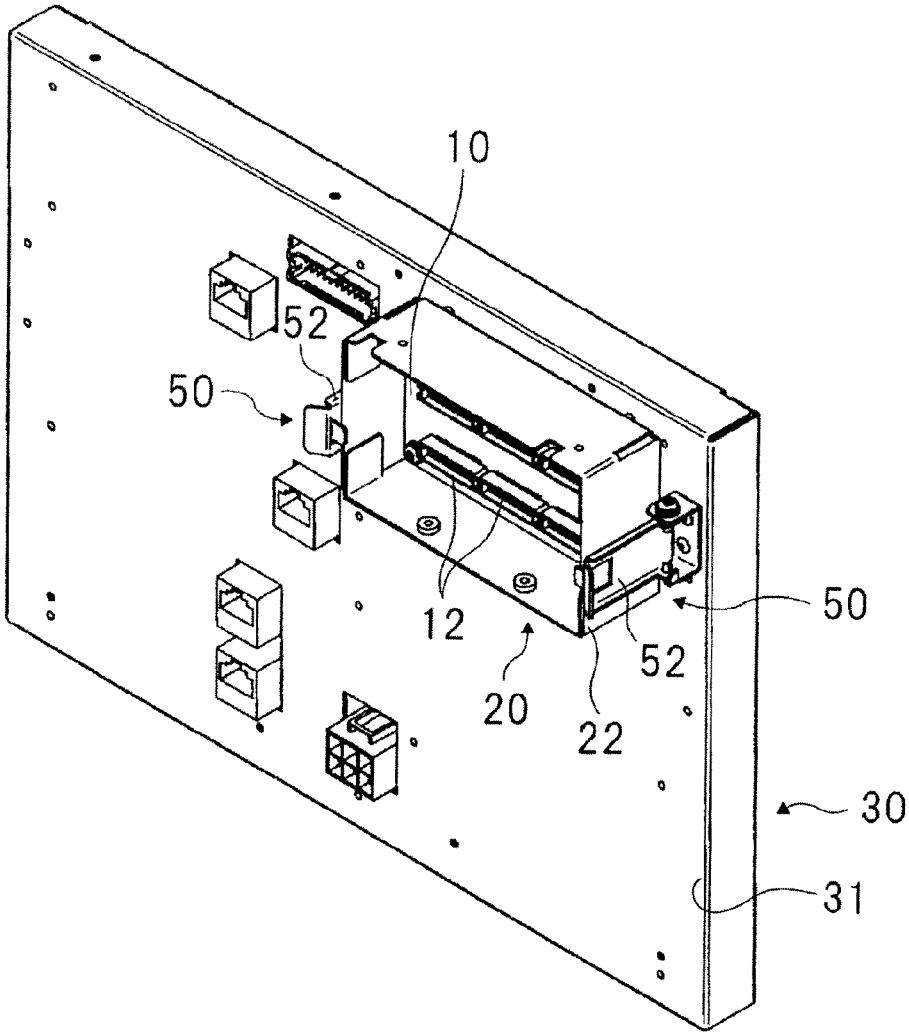
FIG. 5 A perspective view showing the relay substrate connected to the main substrate.

FIG. 5 shows a completely connected state of common connector 14 and main connector 40. In this case, hinge 50 rotates to a position where operation part 52 is roughly perpendicular to main surface 31 of support housing 30. In other words, hinge 50 rotates to a position where operation part 52 is roughly parallel to side wall 22 of shield housing 20.

Figure 6A:
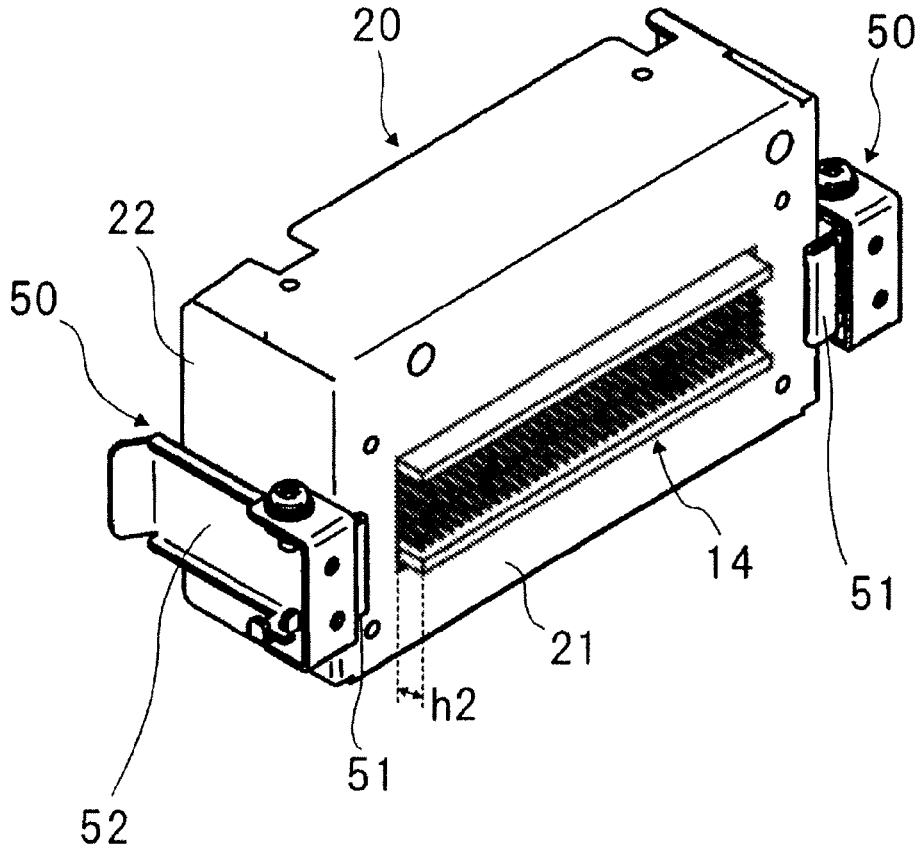
FIG. 6A A first perspective view showing the shield housing attached to the support housing.
Figure 6B:
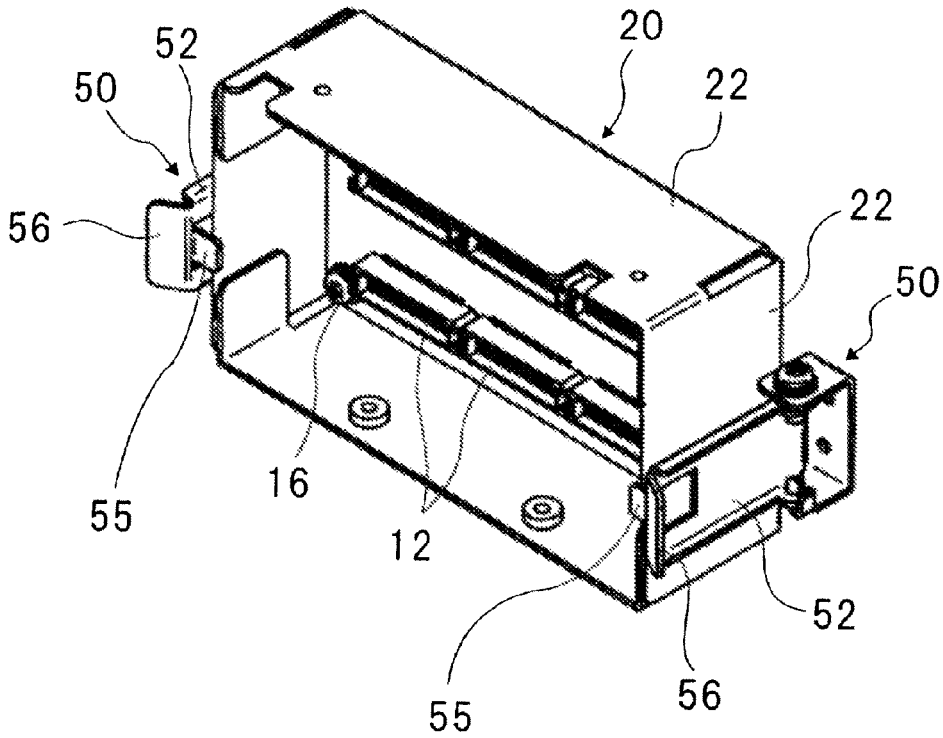
FIG. 6B A second perspective view showing the shield housing attached to the support housing.

FIGS. 6A and 6B are enlarged views showing hinge 50 rotated to the position shown in FIG. 5. In FIGS. 6A and 6B, the support housing is not shown for convenience. As shown in FIG. 6A, when hinge 50 rotates to the position shown in FIG. 5, working part 51 of hinge 50 is located between bottom part 21 of shield housing 20 and main surface 31 (FIG. 5) of support housing 30 that faces each other. As shown in FIG. 6B, operation part 52 of hinge 50 is provided with a projection (fixed part 55) formed to extend roughly perpendicularly from operation part 52. When hinge 50 rotates to the position shown in FIG. 5, fixed part 55 covers the end surface of side wall 22 of shield housing 20 to prevent pulling-out of common connector 14 (FIG. 1B).

Next, a procedure for removing relay substrate 10 from the main substrate will be described.

Figure 7A:
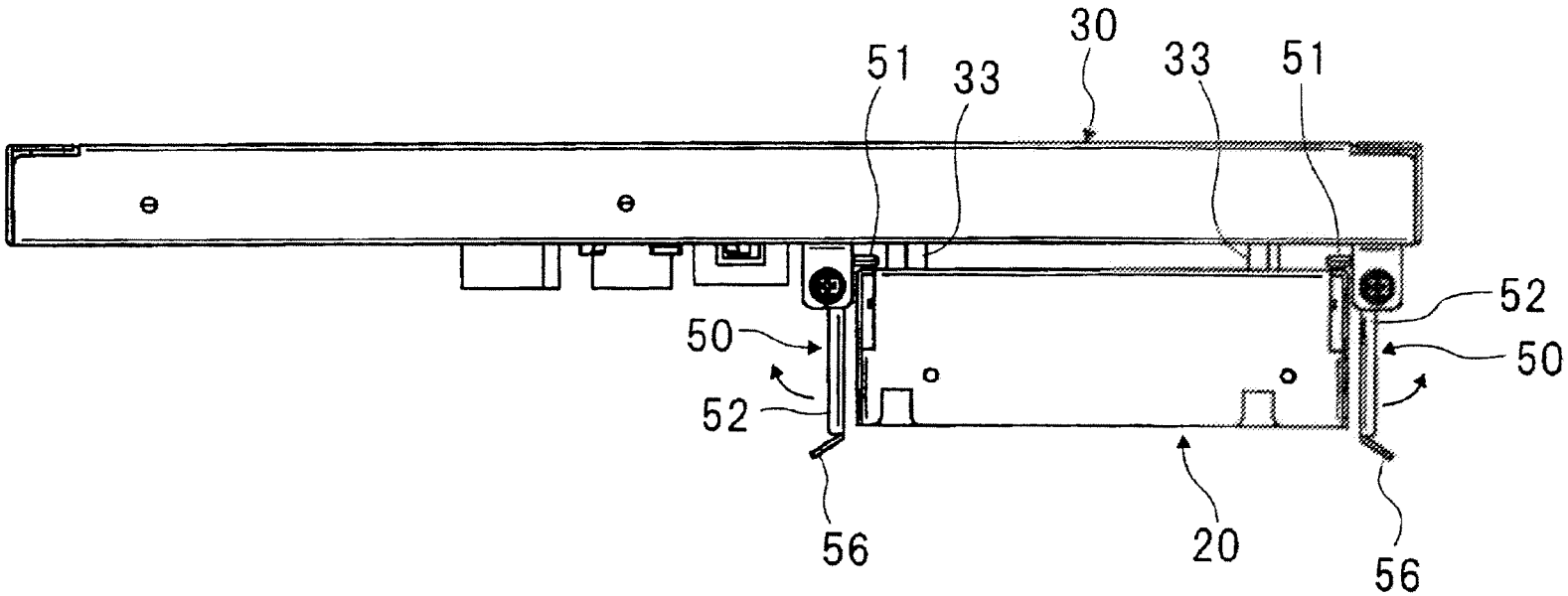
FIG. 7A A first plan view showing a procedure for disconnecting the relay substrate from the main substrate.
Figure 7B:
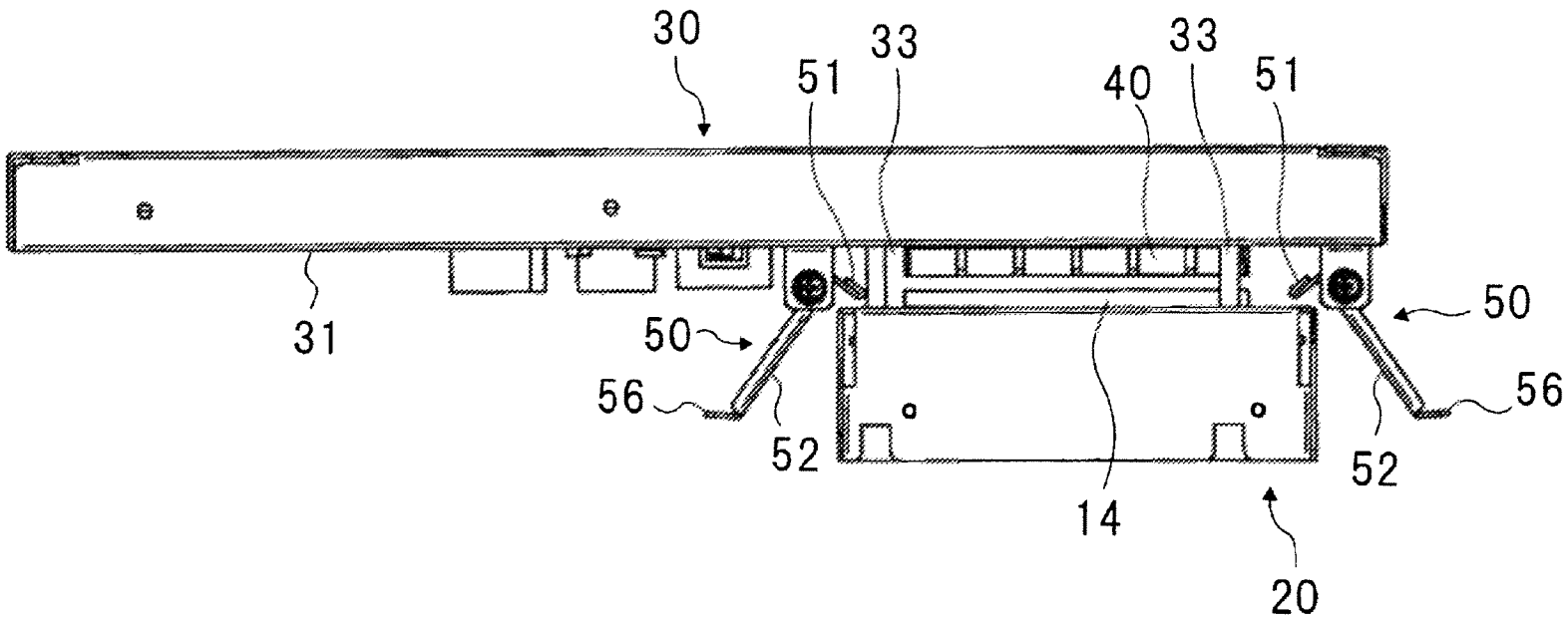
FIG. 7B A second plan view showing the procedure for disconnecting the relay substrate from the main substrate.

As shown in FIG. 7A, bent parts 56 provided in the leading ends of operation parts 52 of hinges 50 are pushed to open left and right hinges 50 outside. In other words, left and right hinges 50 are rotated in arrow directions. Then, as shown in FIG. 7B, bottom part 21 of shield housing 20 is pushed by working parts 51 of hinges 50. When hinges 50 are further rotated, shield housing 20 pushed by working parts 51 is separated from support housing 30 to disconnect common connector 14 from main connector 40.

In other words, common connector 14 is pulled out from main connector 40 by the principle of leverage. Thus, common connector 14 can be pulled out from main connector 40 by a small force. Further, shield housing 20 is guided by guide pins 33 and guide tubes 25 (FIG. 2A) to move in parallel. In other words, shield housing 20 moves perpendicularly to main surface 31 of support housing 30. Thus, common connector 14 is pulled out straight from main connector 40. In summary, common connector 14 can be pulled out straight from main connector 40 by a small force.

Guide pin 33 has sufficient length to enable it to remain in guide tube 25 even after common connector 14 has been pulled out from main connector 40. Thus, even after the disconnection of common connector 14 from main connector 40, shield housing 20 is supported by guide pins 33 so that it is prevented from falling off.

As shown in FIG. 5, distribution connectors 12 provided in relay substrate 10 connected to main connector 40 are surrounded with shield housing 20. This suppresses leakage of electromagnetic waves radiated from the cables (not shown) connected to distribution connectors 12 to the outside. As described above, in the state shown in FIG. 5, guide pins 33 (FIG. 3A) provided in support housing 30 are inserted into guide tubes 25 (FIG. 2A) provided in shield housing 20. Further, metal guide tube 25 and metal guide pin 30 are in electrical contact with each other. In other words, relay substrate 10 is in electrical contact with fixed substrate 30 via shield housing 20. As a result, the reliability of the ground connection of relay substrate 10 is further ensured, and leakage of electromagnetic waves is further prevented.

Figure 8:
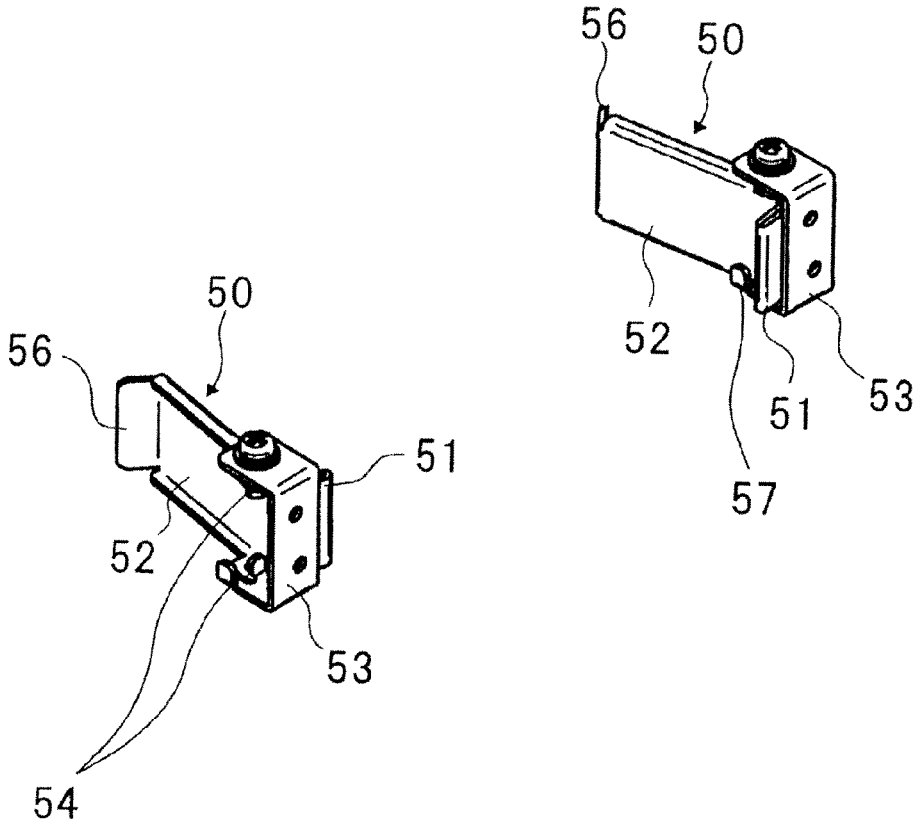
FIG. 8 An enlarged perspective view showing a hinge and a bracket.
Figure 9:
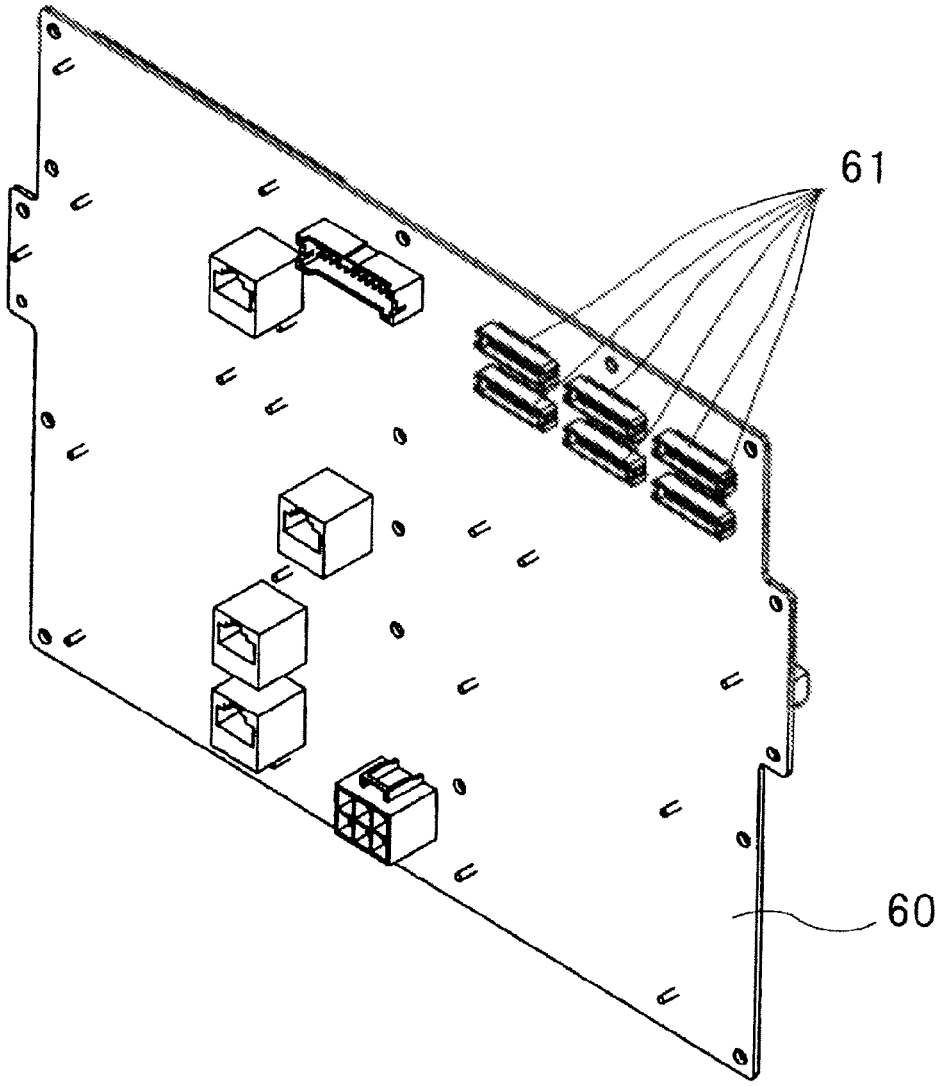
FIG. 9 A perspective view showing a main substrate related to the present invention.

As shown in FIG. 8, bracket 53 for supporting hinge 50 is provided with stopper 57 for limiting the rotation of hinge 50. To connect common connector 14 to main connector 40, shield housing 20 must be set between two opposing hinges 50 (refer to FIG. 4). In this case, when at least one of two hinges 50 is closed in the arrow direction shown in FIG. 4, shield housing 20 cannot be set between two hinges 50. Stopper 57 accordingly limits the inward rotational amount of hinge 50. Specifically, rotational amounts of hinges 50 are limited to prevent the gap between opposing hinges 50, more specifically, the gap between opposing operation parts 52, from being narrower than the width of shield housing 20.

EXPLANATION OF REFERENCE NUMERALS

10 Relay substrate
12 Distribution connector
14 Common connector
20 Shield housing
21 Bottom part
22 Side wall
25 Guide tube
30 Support housing
33 Guide pin
40 Main connector
50 Hinge
51 Working part
52 Operation part
53 Bracket
55 Fixed part
57 Stopper

The invention claimed is:

1. A connecting structure for a main substrate and a relay substrate, the main substrate being provided with a first connector, the relay substrate being provided with a second connector connected to the first connector and a plurality of third connectors connected to the second connector, the structure comprising:

a support housing to which the main substrate is attached; and a shield housing for housing the relay substrate, the support housing being provided with a first opening for exposing the first connector provided in the main substrate, a first guide, and a pair of hinges;

the shield housing being provided with a second opening for exposing the second connector provided in the relay substrate, and a second guide that works cooperatively with the first guide;

the first guide and the second guide guiding the shield housing so that the shield housing can move perpendicularly to a main surface of the support housing provided with the first opening;

ends of the pair of hinges being located between the shield housing and the support housing and being adapted to be rotated to separate the shield housing from the support housing.

2. The connecting structure according to claim 1, wherein:

the shield housing has a bottom part in which the second opening and the second guide are provided, and a side wall rising from each side of the bottom part; and the relay substrate is fixed to an inner surface of the bottom part of the shield housing to expose the second connector from the second opening to the outside.

3. The connecting structure according to claim 2, wherein the first guide and the second guide are in electrical contact with each other when the first connector is connected to the second connector.

4. The connecting structure according to claim 2, wherein:

the first guide comprises a pin projecting from the main surface of the support housing;

the second guide comprises a tube into which the pin can be inserted; and the first guide has a length that facilitates start entry into the second guide before the second connector comes into contact with the first connector.

5. The connecting structure according to claim 2, wherein the hinge includes a working part which is located between the shield housing and the support housing when the first connector is connected to the second connector, and an operation part extending roughly perpendicularly from one end of the working part, and a corner part between the working part and the operation part is rotatably supported by a shaft.

6. The connecting structure according to claim 2, wherein the operation part of the hinge is provided with a projection which is engaged with the shield housing when the first connector is connected to the second connector.

7. The connecting structure according to claim 1, wherein the first guide and the second guide are in electrical contact with each other when the first connector is connected to the second connector.

8. The connecting structure according to claim 7, wherein:

the first guide is a pin projecting from the main surface of the support housing;

the second guide is a tube into which the pin can be inserted; and the first guide has a length that facilitates start entry into the second guide before the second connector comes into contact with the first connector.

9. The connecting structure according to claim 7, wherein the hinge includes a working part which is located between the shield housing and the support housing when the first connector is connected to the second connector, and an operation part extending roughly perpendicularly from one end of the working part, and a corner part between the working part and the operation part is rotatably supported by a shaft.

10. The connecting structure according to claim 7, wherein the operation part of the hinge is provided with a projection which is engaged with the shield housing when the first connector is connected to the second connector.

11. The connecting structure according to claim 1, wherein:

the first guide comprises a pin projecting from the main surface of the support housing;

the second guide comprises a tube into which the pin can be inserted; and the first guide has a length that facilitates start entry into the second guide before the second connector comes into contact with the first connector.

12. The connecting structure according to claim 11, wherein the hinge includes a working part which is located between the shield housing and the support housing when the first connector is connected to the second connector, and an operation part extending roughly perpendicularly from one end of the working part, and a corner part between the working part and the operation part is rotatably supported by a shaft.

13. The connecting structure according to claim 11, wherein the operation part of the hinge is provided with a projection which is engaged with the shield housing when the first connector is connected to the second connector.

14. The connecting structure according to claim 1, wherein the hinge includes a working part which is located between the shield housing and the support housing when the first connector is connected to the second connector, and an operation part extending roughly perpendicularly from one end of the working part, and a corner part between the working part and the operation part is rotatably supported by a shaft.

15. The connecting structure according to claim 14, wherein the operation part of the hinge is provided with a projection which is engaged with the shield housing when the first connector is connected to the second connector.

16. The connecting structure according to claim 1, wherein the operation part of the hinge is provided with a projection which is engaged with the shield housing when the first connector is connected to the second connector.

* * * * *